United States Patent [19]

Warner et al.

[11] Patent Number: 4,564,830

[45] Date of Patent: Jan. 14, 1986

[54] WOUND-IN SLEEVE FUSE CUTOUT TUBE CONSTRUCTION

[75] Inventors: Dean C. Warner, Portville; James R. Marek, Olean, both of N.Y.

[73] Assignee: Cooper Industries, Inc., Houston, Tex.

[21] Appl. No.: 633,627

[22] Filed: Jul. 23, 1984

[51] Int. Cl.[4] ..... H01H 85/14

[52] U.S. Cl. ..... 337/246; 337/279

[58] Field of Search ..... 337/246, 249, 250, 279, 337/273, 275, 278, 280, 281, 282

[56] References Cited

U.S. PATENT DOCUMENTS

| | | | |
|---|---|---|---|
| 2,325,416 | 7/1943 | McMahon | 337/279 |
| 2,343,422 | 3/1944 | Rawlings | 337/275 |
| 3,374,329 | 3/1968 | Bronikowski | 337/279 |

FOREIGN PATENT DOCUMENTS

| | | | |
|---|---|---|---|
| 1150133 | 6/1963 | Fed. Rep. of Germany | 337/279 |

*Primary Examiner*—Harold Broome

*Attorney, Agent, or Firm*—Eddie E. Scott; Nelson A. Blish; Alan R. Thiele

[57] ABSTRACT

An expulsion type fuse cutout fuseholder structural assembly (10) including a fuse tube assembly (12) having a bone fiber liner (40) and a sleeve insert (36) coaxially disposed entirely interiorly within an insulative outer covering or wrapping (14). A rabbet joint is defined between the mated ends of the liner (40) and sleeve insert (36) by means of a counterbored portion (48) of the liner (40) and an axially projecting tubular portion (44) of the sleeve insert (36). In addition, each of the bone fiber liner (40) and sleeve insert (36) components is provided with a spiral groove (42,38) within which the inner layers of the outer covering or wrapping (14) are disposed during the wrapping fabrication of the fuse tube assembly (12). In this manner, all three structural components of the fuse tube assembly (12), that is, the sleeve (36), the liner (40), and the outer covering or wrapping (14), are all integrally interconnected together, whereby any one of the components is fixedly interconnected with the other two components. Such an improved structural assembly (12) enhances the interruption rating of the fuse cutout fuseholder structural assembly (10), in view of the fact that the structural integrity of the fuse tube assembly (12) is able to be maintained under the high-temperature, pressurized gaseous conditions attendant current fault conditions.

8 Claims, 4 Drawing Figures

WOUND-IN SLEEVE FUSE CUTOUT TUBE CONSTRUCTION

BACKGROUND OF THE INVENTION

The present invention relates generally to electrical circuit interrupting means, and more particularly, to a new and improved expulsion type fuse cutout fuseholder structural assembly which, in addition to being capable of achieving interruptions under low fault current conditions, can also in fact, achieve high fault current interruptions so as to provide a fuse cutout with an interruption rating of 8000 amps within a 38 KV fuse cutout.

In connection with the interruption of fault current conditions within an electrical circuit, conventional expulsion type fuse cutout fuseholder structural assemblies rely upon the intense heat of the electric arc, which develops as a result of the rupture of the fuse link, to vaporize a bone fiber liner, disposed internally of the fuse tube outer covering, into various gases, such as, for example, carbon monoxide, water vapor, methane, hydrogen, and the like, whereby such evolved gases serve to expurgate the entire interior bore of the fuse tube assembly and thereby provide the entire interior bore of the fuse tube assembly with an environment within which the arc cannot re-establish itself at and after current zero, a phenomenon known in the art as re-igniting or re-striking. In view of the fact that an arc that persists for several cycles can be extremely damaged to a particular piece of electrical equipment disposed within the circuit, it is operatively mandatory that the aforenoted expurgation of the entire interior bore of the fuse tube assembly be achieved by the first current zero after element melting under both low and high current fault conditions.

Since the aforenoted gases are generated or evolved at a substantially high rate of speed and within a relatively confined area or volume, as defined by means of the interior bore of the fuse tube assembly, substantial pressure is developed internally of the fuse tube assembly, and this pressure is utilized to expel the ionized gases developed within the fuse tube assembly as a result, for example, of the ablation and vaporization of the fuse tube assembly bone fiber liner, as well as, the melting and destruction of the fuse link and the link auxiliary tube, whereby the aforenoted environment within the fuse tube assembly is achieved. The buildup of pressure within the fuse tube assembly, and the subsequent expulsion-venting of the gases from the fuse tube assembly, within an extremely short, relative period of time, however, leads to the development of substantial thrust and reaction forces upon the entire fuse tube assembly. During particular instances of current fault interruption conditions, the magnitude of such forces may reach such a value that portions or components of the fuse tube assembly may be permanently deformed or otherwise damaged. In view of the fact that greater pressures manifest themselves under high current fault conditions, the potential also exists for the rupturing of the fuse tube assembly if excessive pressure levels develop within the fuse tube assembly.

In order to effectively limit the maximum pressure levels and eliminate the potential for the occurance of such aforementioned deleterious effects upon the fuse tube assembly, conventional fuse tube constructions sought to provide the fuse tube assemblies with an interior bore diametrically larger than that of previous fuse tube assembly bores. Such an solution served, however, to increase the interior volume of the fuse tube assembly bore, and therefore effectively reduce the pressure level of a predetermined volume of evolved gas. The surface area of the fuse tube assembly bone fiber liner exposed to the arc generated within the fuse tube assembly is, however, dramatically increased. Consequently, a substantial reduction in relative pressure levels is not in fact achieved. In addition, by increasing the interior diameter of the fuse tube assembly bore, such conventional fuse tube constructions experienced additional operational difficulties in that such fuse tube assemblies were not capable of consistently clearing the circuit at the first curent zero, but, to the contrary, permitted the arcs to persist for several additional cycles. This problem is particularly acute under low current fault conditions in view of the fact that under certain transient conditions, the enlarged fuse tube assembly bore prevented sufficient pressure from developing within the fuse tube assembly so as to expurgate the tube and thereby prevent the re-ignition or re-striking of the arc.

In order to therefore overcome these various operational disadvantages characteristic of high and low current fault conditions, another prior art or conventional fuse tube assembly construction, as exemplified by means of U.S. Pat. No. 3,102,178, issued to Raymond J. Bronikowski, entitled, "Fuse Tube Construction", and assigned to the assignee of the present application, does not increase the relative diametrical size of the fuse tube assembly bore, but to the contrary, incorporates therewithin a conductive sleeve which is disposed interiorly of the fuse tube assembly and interposed between two sections of the fuse tube assembly bone fiber liner. As a result of this particular construction, not only is the interior diametrical bore size of the fuse tube assembly preserved, whereby low current fault interruptions are facilitated as a result of the maintenance of sufficient pressure levels within the fuse tube assembly, but in addition, the volumetric amount of the gas-evolving bone fiber liner is effectively reduced, whereby high current fault interruptions are likewise facilitated in view of the fact that the pressure levels developed within the fuse tube assembly bore are effectively limited.

It may thus be appreciated that the foregoing fuse tube assembly construction performs admirably throughout the low and high fault current ranges, however, several operational disadvantages or drawbacks have become evident as posing potential problems, during actual field site usage, whereby it is not only possible that damage to equipment may be experienced as a result of arc re-ignition or re-striking, but in addition, damage to the fuse tube assembly may likewise be experienced as a result of deformation, distortion, erosion, or ablation of the fuse tube assembly bone fiber liner and conductive sleeve components, as well as a result of the physical separation of the fuse tube assembly bone fiber liner relative to the conductive sleeve and outer covering or wrapping components. For example, it is noted in connection with the embodiment of FIG. 2, of the Bronikowski patent, that the wall thickness dimension of the conductive sleeve component is relatively small, and consequently, during high current fault conditions, ablation or erosion of the sleeve can eliminate the serviceability of the conductive sleeve, or substantialy reduce its service life. It should also be noted at this juncture, that while the conductive sleeves employed within the embodiments of FIGS. 3 and 4, of the Bronikowski patent, exhibit portions which have thickness dimensions which are relatively large, or at least substantially greater than the corresponding radial thickness dimension characteristic of the embodiment of FIG. 2, the conductive sleeves of the embodiments of FIGS. 3 and 4, are exposed to the environment external to the fuse tube assembly, whereby the potentially undesirable conditions facilitating flashover are present.

Continuing still further, in view of the fact that within all of the structural embodiments of the Bronikowski patent, there is no integral or fixed structural interconnection defined between the bone fiber liner and the outer covering or wrapping, or similarly between the bone fiber liner and the conductive sleeve, the gases evolved from the bone fiber liner tend to be thrust between the end surfaces of the bone fiber liner and the conductive sleeve (which are in simple butt contact with each other), as well as behind the conductive sleeve, under the pressurized conditions existing within the fuse tube assembly bore. As a result of such pressurized gaseous thrust forces acting upon the conductive sleeve, the sleeve tends to be distorted or deformed, or separated from the bone fiber liner and outer covering or wrapping. These conditions are, of course, entirely undesirable in that the conductive sleeve may tend to become jammed within the fuse tube assembly bore, or at least substantially block the same, thereby preventing the desirably required pressurized evacuation of the bone fiber liner gases from the fuse tube assembly bore. Such an operational failure of the fuse tube assembly can also lead to rupturing or bursting of the fuse tube assembly, or damage to other components of the entire fuseholder assembly, and in addition, in view of the fact that the interior environment of the fuse tube assembly has not been properly and completely expurgated, arcing within the circuit may continue to persist.

Accordingly, it is an object of the present invention to provide a new and improved expulsion type fuse cutout fuseholder structural assembly.

Another object of the present invention is to provide a new and improved expulsion type fuse cutout fuseholder structural assembly which overcomes the various disadvantages and operational drawbacks characteristic of prior art or conventional expulsion type fuse cutout fuseholder structural assemblies.

Yet another object of the present invention is to provide a new and improved expulsion type fuse cutout fuseholder structural assembly which, in addition to properly performing electrical line or circuit interruptions under low current fault conditions, can also properly perform electrical line or circuit interruptions under high current fault conditions.

Still another object of the present invention is to provide a new and improved expulsion type fuse cutout fuseholder structural assembly with an interruption rating which is substantially greater or higher than prior art or conventional expulsion type fuse cutout fuseholder structural assemblies.

Yet still another object of the present invention is to provide a new and improved expulsion type fuse cutout fuseholder structural assembly which provides for the integral interconnection defined between the fuse tube assembly bone fiber liner and the sleeve insert, as well as the integral interconnection defined between the fuse tube assembly bone fiber liner and the outer covering or wrapping.

Still yet another object of the present invention is to provide a new and improved expulsion type fuse cutout fuseholder structural assembly which provides for the integral interconnection defined between the fuse tube assembly sleeve insert and the outer covering or wrapping, while maintaining the sleeve insert housed entirely interiorly within the outer covering or wrapping.

A further object of the present invention is to provide a new and improved expulsion type fuse cutout fuseholder structural assembly which effectively limits the pressurization levels developed internally within the fuse tube assembly under high current fault conditions, while permitting sufficient pressurization levels to develop internally within the fuse tube assembly under low current fault conditions, whereby desirable electrical line or circuit interruptions can, in fact, be properly achieved both under low and high current fault conditions.

A yet further object of the present invention is to provide a new and improved expulsion type fuse cutout fuseholder structural assembly wherein the fuse tube assembly bone fiber liner, the fuse tube assembly sleeve insert, and the outer covering or wrapping components are integrally connected together so as to enhance the structural integrity of the fuse tube assembly, whereby the fuse tube assembly can effectively withstand the increased pressurization levels developed internally within the fuse tube assembly attendant high current fault conditions without distortion or rupture of the fuse tube assembly or any of its components, and thereby exhibit a higher interruption rating than is capable of currently being achieved with conventional fuse cutout fuseholder structural assemblies.

A still further object of the present invention is to provide a new and improved expulsion type fuse cutout fuseholder structural assembly wherein the fuse tube assembly bone fiber liner is integrally connected to the fuse tube assembly sleeve insert, as well as to the outer covering or wrapping, whereby the tendency of separation, distortion, deformation, or the like, of the fuse tube assembly bone fiber liner relative to the fuse tube assembly sleeve insert and the outer covering or wrapping under high pressurization conditions is effectively counterbalanced.

A yet still further object of the present invention is to provide a new and improved expulsion type fuse cutout fuseholder structural assembly wherein the fuse tube assembly is provided with sufficient radial wall thickness so as to effectively counteract the tendency for the fuse tube assembly sleeve insert to undergo ablation or erosion under high current fault conditions, while, nevertheless, being retained entirely interiorly within the fuse tube assembly outer covering or wrapping so as to eliminate any potentially dangerous flashover conditions from developing.

A still yet further object of the present invention is to provide a new and improved expulsion type fuse cutout fuseholder structural assembly wherein the fuse tube assembly sleeve insert is provided with sufficient radial wall thickness so as to effectively counteract any tendency for the fuse tube assembly sleeve insert to undergo ablation or erosion under high current fault conditions, and is housed entirely internally within the fuse tube assembly outer covering or wrapping, however, the diametrical extent of the fuse tube assembly bore has a value which is comparable to conventional fuse tube asesmbly bores so as not to adversely affect low and high current fault interruption capabilities of the fuse tube assembly.

An additional object of the present invention is to provide a new and improved expulsion type fuse cutout fuseholder structural assembly which exhibits enhanced structural integrity, whereby in accordance with accepted industry standards, the assembly can successfully clear the maximum rating of the cutout assembly a minimum of three successive times, and subsequent to the third such interruption, nevertheless, remain capable of carrying the rated value of continuous current.

A yet additional object of the present invention is to provide a new and improved expulsion type fuse cutout fuseholder structural assembly which exhibits enhanced structural integrity, whereby even under high current fault conditions, the structural assembly will remain intact and not exhibit disruptive plastic deformation or distortion requiring extensive replacement of component parts or even the entire fuse cutout fuseholder structural assembly.

A still further additional object of the present invention is to provide a new and improved expulsion type fuse cutout fuseholder structural assembly which can be economically manufactured.

SUMMARY OF THE INVENTION

The foregoing and other objectives are achieved in accordance with the present invention through the provision of a new and improved expulsion type fuse cutout fuseholder structural assembly which comprises a fuse tube assembly within which is disposed a sleeve or tubular insert, fabricated, for example, from a suitable conductive metal, such as, for example, copper, stainless steel, or the like, or alternatively, a suitable ceramic material which is capable of withstanding the intensive heat and temperature levels of an arc, which may tend to develop within the fuse tube assembly as a result of a high or low fault current condition. A bone fiber tubular liner or insert is also disposed internally within the fuse tube assembly, and each end of the sleeve insert which is adapted to be mated with an end of the bone fiber liner is provided with an axially extending annulus along the radially innermost wall portion thereof, whereby an annular shoulder is defined along the radially outermost wall portion thereof, while in a similar, corresponding manner, each end of the bone fiber liner which is adapted to be mated with an end of the sleeve insert is counterbored along the radially innermost wall portion thereof. In this manner, a press-fitted rabbet joint is defined between the mating ends of the bone fiber liner and the sleeve insert.

Continuing further, and more particularly, the bone fiber liner and sleeve insert components of the fuse tube assembly are adapted to be disposed internally within an outer, insulating covering or wrapping fabricated, for example, from a suitable epoxy material reinforced with fiberglass, or alternatively, a phenolic thermosetting resin reinforced with paper. In accordance with further features of the present invention, a spiral groove is formed within the external surface of the bone fiber liner, and a similar groove is likewise formed within the external surface of the sleeve insert. In this manner, when the insulating covering or wrapping is disposed about the tubular bone fiber liner and the tubular sleeve insert, the innermost layer or layers of the insulating covering or wrapping are disposed within the external grooves defined within the outer surfaces of the bone fiber liner and the sleeve insert. Consequently, the bone fiber liner and the sleeve insert components will be integrally connected to the fuse tube assembly outer covering or wrapping, and in addition, as a result of the aforenoted rabbet joint conections defined between the mating ends of the bone fiber liner and the sleeve insert, the three fuse tube assembly components, that is, the bone fiber liner, the sleeve insert, and the outer covering or wrapping, are all integrally mated or interconnected together, and in particular, each single component of the fuse tube assembly is affixedly secured to the other two fuse tube assembly components. In light of this unique structural interrelationship defined between the fuse tube assembly components, the fuse tube assembly exhibits substantially increased structural rigidity and integrity, whereby the fuse cutout fuseholder structural assembly of the present invention is capable of substantially higher fault current interruption ratings than was heretofore possible by means of conventional expulsion type fuse cutout fuseholder structural assemblies.

Various other objects, features, and attendant advantages of the present invention will be more fully appreciated as the same becomes better understood from the following detailed description when considered in connection with the accompanying drawings, in which like reference characters designate like or corresponding parts throughout the several views.

DESCRIPTION OF THE PREFERRED EMBODIMENT

Figure 1:
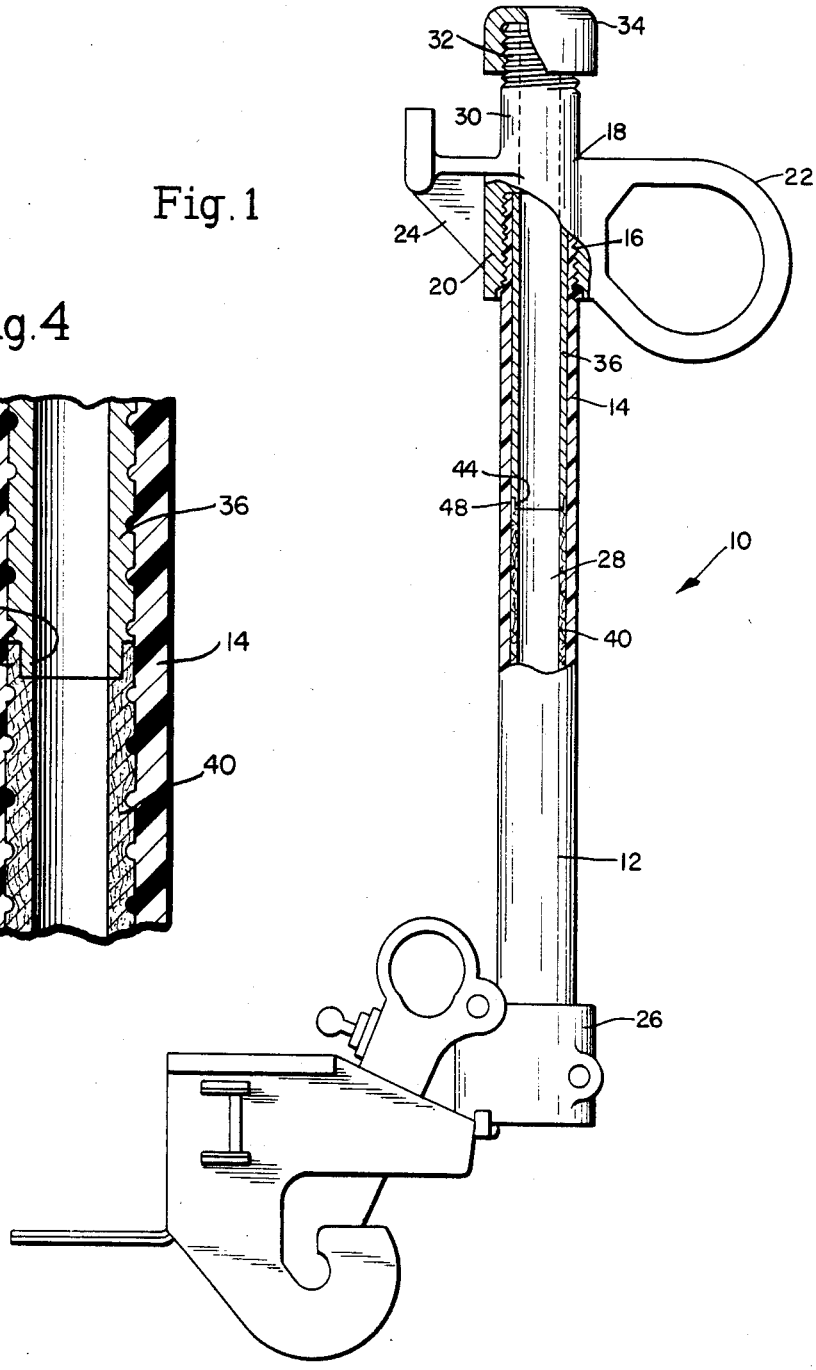
FIG. 1 is a side elevation view, partly in cross-section, of a new and improved expulsion type fuse cutout fuseholder structural assembly constructed in accordance with the present invention and showing the cooperative parts thereof.

Referring now to the drawings, and more particularly to FIG. 1 thereof, there is shown the new and improved expulsion type fuse cutout fuseholder structural assembly as generally indicated by the reference character 10. As is conventional, the expulsion fuse cutout fuseholder structural assembly 10 is seen to comprise a fuse tube assembly 12, and in turn, it is seen that the fuse tube assembly 12 includes an outer, insulating covering 14 fabricated, for example, from a suitable epoxy material reinforced with fiberglass, or alternatively, a phenolic thermosetting resin reinforced with paper. The upper end of the fuse tube assembly 12, and more particularly the upper end of the outer covering or wrapping 14, is provided with an externally threaded portion 16, and in this manner, an upper terminal contact member 18 may be threaded securely upon the upper end of the fuse tube assembly 12, as a result of threaded interengagement defined between an internally threaded ferrule portion 20 of member 18, and the threaded portion 16 of fuse tube assembly outer covering or wrapping 14. Ferrule 20 is integrally formed with upper terminal contact member 18, as is a pull-ring assembly 22 and a contact arm 24. A lower terminal contact assembly 26 is affixed upon the lower end of the fuse tube assembly 12, so as to likewise be disposed externally about outer covering or wrapping 14 in a manner similar to the mounting of upper terminal contact 18, relative to outer covering or wrapping 14. The axially spaced upper and lower terminal contacts 18 and 26 are in electrical contact with stationary contacts (not shown), disposed upon fuse support arms (also not shown), and are also in electrical engagement with each other through means of a fuse link which extends substantially axially through the internal bore 28 of the fuse tube assembly 12 (the fuse link having been omitted from the drawings for clarity purposes). Upper terminal contact member 18 is provided with an upstanding tubular portion 30, which is externally threaded at the upper end 32 thereof. An internally threaded closure cap 34 is threadedly engaged upon tubular portion 30, so as to close the upper end of the fuse tube assembly bore 28.

The fuse tube assembly 12 is further conventionally provided with a tubular sleeve insert 36, which may be fabricated, for example, from a suitable conductive metal material, such as, for example, copper, stainless steel, or the like, or alternatively, the insert may also be fabricated from a suitable ceramic material which is capable of withstanding the intensive heat and temperature levels attendant an arc, which may tend to develop within the fuse tube assembly 12, as a result of high or low current fault conditions. In accordance with one of the particularly unique features of the present invention, and with additional reference being made to FIG. 4, of the drawings, it is seen that the sleeve insert 36 is disposed entirely internally within the fuse tube assembly outer covering or wrapping 14 in an integrally interconnected, interengaged manner. As best seen from FIG. 2, the outer surface of the sleeve insert 36 is provided with a continuous spiral groove or thread 38, which progresses axially from one end of the sleeve insert 36 to the other. In accordance with another feature of the present invention, the fuse tube assembly outer covering or wrapping 14, which, as has been noted hereinbefore, may be fabricated from a suitable epoxy material reinforced with fiberglass, or alternatively, a phenolic thermosetting resin reinforced with paper, is wrapped about or around the exterior surface of the sleeve insert 36, when the latter is suitably disposed upon a mandrel component or workholder of a fuse tube assembly manufacturing apparatus. In this manner, the innermost layer or layers of the fuse tube assembly insulating outer covering or wrapping 14 are disposed within the external grooves or thread 38 of the sleeve insert 36, thereby defining the integral, mechanical interconnection means between the sleeve insert 36 and the fuse tube assembly outer covering or wrapping 14.

Figure 3:
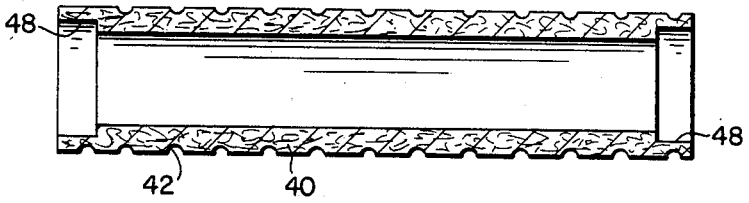
FIG. 3 is an axial cross-sectional view of the new and improved fuse tube assembly bone fiber liner constructed in accordance with the present invention and employed within the fuse cutout fuseholder structural assembly disclosed within FIG. 1.

Continuing further, and with additional reference now being made to FIG. 3, a tubular bone fiber liner 40 is also housed entirely internally within the fuse tube assembly outer covering or wrapping 14, however, in accordance with another particularly unique feature of the present invention, the outer circumferential surface of the tubular bone fiber liner 40 is, in a manner similar to that of the sleeve insert 36, also provided with a spiral groove or thread 42, which extends continuously throughout the axial length of the bone fiber liner 40 from one end thereof to the other. In this manner, when, for example, the bone fiber liner 40 is mounted upon the aforenoted mandrel structure of the fuse tube assembly manufacturing apparatus, and the covering or wrapping 14 is wrapped thereabout, the innermost layer or layers of the fuse tube assembly covering or wrapping 14 will be disposed within the spiral groove or thread 42, of the bone fiber liner 40, thereby defining an integral, mechanical interconnection means or system in a manner similar to that defined between covering or wrapping 14 and the sleeve insert 36.

Figure 4:
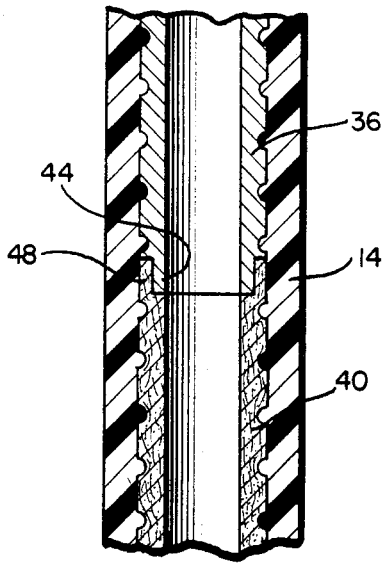
FIG. 4 is an enlarged partial cross-sectional view of the joint between the bone fiber liner and sleeve insert as constructed in accordance with the present invention and employed within the fuse cutout fuseholder structural assembly disclosed within FIG. 1.
Figure 2:
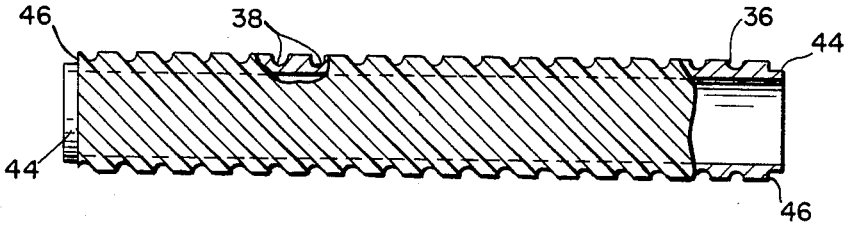
FIG. 2 is a side elevation view, partly in cross-section, of the new and improved sleeve insert constructed in accordance with the present invention and employed within the fuse cutout fuseholder structural assembly disclosed within FIG. 1.

With reference now being particularly made to both FIGS. 2 and 3, it is to be further appreciated that each end of the sleeve insert 36 which is adapted to be matingly engaged with a corresponding end of the bone fiber liner 40 is provided with an axially extending annulus or tubular portion 44, along the radially innermost wall portion thereof, whereby, in turn, an annular shoulder portion 46 is defined thereabout upon each end of the sleeve insert 36 on the radially outer-most wall portion thereof. In a similar, corresponding manner, each end of the bone fiber liner 40, which is adapted to be matingly engaged with an end of the sleeve insert 36, is counterbored, as at 48. In this manner, when one end of the sleeve insert 36 and a corresponding end of the bone fiber liner 40 are mated together, as best seen in FIG. 4, a press-fitted or friction-fitted rabbet joint is defined therebetween. As a result of such aforenoted rabbet joint, and in addition to the effectively threaded interengagement defined between the outer covering or wrapping 14, and each of the sleeve insert 36 and bone fiber liner 40 components, all three of the fuse tube assembly components are mechanically interconnected together, such that any one of the three fuse tube assembly components, comprising the bone fiber liner 40, the sleeve insert 36, and the fuse tube assembly outer covering or wrapping 14, is fixedly secured or connected to the other two fuse tube assembly components. Consequently, a structurally rigid fuse tube assembly is established which is especially capable of withstanding the various forces, pressures, and the like characteristic of high current fault conditions without exhibiting the deleterious effects, such as has been, in fact, heretofore exhibited in conventional fuse tube assemblies. Specifically, not only are the sleeve insert 36 and bone fiber liner 40 elements or components individually fixedly and integrally connected to the fuse tube assembly outer covering or wrapping 14, while being disposed entirely interiorly thereof, but more importantly, the bone fiber liner element or component 40 is fixedly and integrally connected to the sleeve insert element or component 36 by means of their respective rabbet joint structures 48 and 44. Still further, it is noted that the rabbet joint structure 48, of the bone fiber liner 40, annularly surrounds the rabbet joint structural component 44, of the sleeve insert 36, and in this manner, substantial resistance is imparted to the bone fiber liner 40, so as to tend to prevent the same from physically separating, for example, from the fuse tube assembly outer covering and wrapping 14, as was characteristic of prior art or conventional fuse cutout fuseholder structural assemblies, under pressurized gaseous conditions.

It is, of course, to be appreciated that all of the fuse tube assembly elements or components comprising the outer covering or wrapping 14, the sleeve insert 36, and the bone fiber liner 40 are concentrically or coaxially arranged with respect to each other. However, it is to be emphasized that in accordance with a specially unique feature of the present invention, the radial thickess of the sleeve insert 36 has a substantial value which will impart sufficient resistance to the sleeve insert 36, so as to be capable of withstanding ablation or erosion pressures or tendencies under high current fault conditions, while, nevertheless, facilitating the housing of the sleeve insert 36 entirely within the fuse tube assembly outer covering or wrapping 14, so as to eliminate any potential flashover tendencies. This increase in radial thickness has been effectively achieved by means of the provision of the spiral groove or thread 38 upon the exterior circumferential surface of the sleeve insert 36, whereby, in effect, the radially outermost circumferential portion of the sleeve insert 36 is embedded within the innermost layer or layers of the fuse tube assembly outer covering or wrapping 14, as opposed to simple circumferential surface contact or engagement being defined between the circumferential surfaces of the sleeve insert 36 and outer covering or wrapping 14 elements or components as was characteristic of conventional fuse tube assemblies, wherein the sleeve insert element 36 was, nevertheless, maintained wholly within of the insulating outer covering or wrapping 14. The foregoing structural relationships are also restricted with the restraint that the diametrical extent or size of the fuse tube assembly bore 28, as defined by means of the sleeve insert 36 and bone fiber liner 40, components must not be decreased or increased from a predeterminedly desired size or value, so as not to adversely affect the deionization and expurgation properties of the fuseholder assembly 10, under both low and high current fault conditions. In particular, it should be remembered that one of the primary purposes for incorporation of the sleeve insert 36 into the fuse tube assembly 12 is to reduce the volumetric amount of bone fiber liner 40, which is exposed to the current fault interruption arc, so as to effectively reduce the pressurization level within the fuse tube assembly 12 under high current fault conditions. However, the internal volume of the fuse tube assembly bore 28 must be effectively maintained so as not to correspondingly adversely affect low current fault interruption capabilities.

It is also to be noted that in view of the fact that, when the sleeve insert 36 is fabricated from a suitable metal material, not only is the sleeve insert 36 electrically conductive, but also an excellent heat conductor, the sleeve insert 36 will therefore also serve as a heat sink with respect to the arc developed within the fuse tube assembly bore 28, and in this manner, the temperature within the fuse tube assembly 12 is effectively lowered, or in other words, the bone fiber liner 40 per se will not be solely exposed to the extreme elevated temperature levels developed by means of the resulting arc. Such a relatively cooler atmosphere or environment within the fuse tube assembly bore 28 serves to evolve less gaseous products from the bone fiber liner 40, as might otherwise be developed or generated.

Obviously, many modifications and variations of the present invention are possible in light of the above teachings. For example, while the sleeve insert 36 has been illustrated as being located or positioned within the upper portion or end of the fuse tube assembly 12, so as to be in contact with the upper terminal contact member 18, the sleeve insert 36 can likewise be disposed at an axially central position within the fuse tube assembly 12, so as to be spaced equidistant from the upper and lower terminal contact members 18 and 26, respectively. Field testing of fuseholder assemblies 10, constructed in accordance with the present invention, has not indicated that any adverse effects are developed when the sleeve insert 36 is disposed in either of such alternative dispositions. It is therefore to be understood that within the scope of appended claims, the present invention may be practiced otherwise than as specifically described herein.

We claim:

1. A fuse cutout tube construction, comprising:

an outer tubular covering component;

a bone fiber liner component disposed internally within said outer tubular covering component having a substantially continuous first spiral groove defined along generally the entire length of its external periphery;

a sleeve insert component disposed internally within said outer tubular covering component having a substantially continuous second spiral groove defined along generally the entire length of its external periphery;

a rabbet joint defined between said bone fiber liner and said sleeve insert components; and said outer tubular covering component being contiguously formed about said bone fiber liner and sleeve insert components within said first and second spiral grooves in a fashion essentially minimizing plastic deformation and separation of the components during high and low fault interrupting conditions.

2. A fuse cutout tube construction, as set forth in claim 1, wherein said rabbet joint comprises:

an axially projecting tubular annulus defined upon the radially inner portion of an end of said sleeve insert which is to be jointly mated with said bone fiber liner, and an annular shoulder portion defined upon the radially outer portion of said end of said sleeve insert; and a counterbore defined within an end of said bone fiber liner which is to be jointly mated with said sleeve insert.

3. A fuse cutout tube construction, as set forth in claim 1, wherein said sleeve insert component is fabricated from a ceramic material.

4. A fuse cutout tube construction, as set forth in claim 1, where said sleeve insert component is fabricated from a conductive metal material.

5. A fuse cutout tube construction, as set forth in claim 4, wherein said conductive metal is copper.

6. A fuse cutout tube construction, as set forth in claim 4, wherein said conductive metal is stainless steel.

7. A fuse cutout tube construction, as set forth in claim 1, wherein said outer tubular covering component is fabricated from an epoxy material reinforced with fiberglass.

8. A fuse cutout tube construction, as set forth in claim 1, wherein said outer tubular covering component is fabricated from a phenolic thermosetting resin material reinforced with paper.

* * * * *